US007913335B2

(12) United States Patent
Carr

(10) Patent No.: US 7,913,335 B2
(45) Date of Patent: Mar. 29, 2011

(54) HIGH/LOW BED

(75) Inventor: Rex Arthur Carr, Plenty (AU)

(73) Assignee: Dunwood Pty. Ltd., Epping (AU)

( * ) Notice: Subject to any disclaimer, the term of this patent is extended or adjusted under 35 U.S.C. 154(b) by 0 days.

(21) Appl. No.: 12/386,131

(22) Filed: Apr. 14, 2009

(65) Prior Publication Data

US 2009/0282616 A1 Nov. 19, 2009

(51) Int. Cl.
*A61G 7/012* (2006.01)

(52) U.S. Cl. ..... 5/611; 5/11; 5/313.1

(58) Field of Classification Search ..... 5/11, 611, 5/509.1, 510, 312, 313.1
See application file for complete search history.

(56) References Cited

U.S. PATENT DOCUMENTS 3,149,348 A * 9/1964 Hillenbrand et al. ..... 5/611
5,347,682 A * 9/1994 Edgerton, Jr. ..... 16/34
5,687,437 A * 11/1997 Goldsmith ..... 5/611
6,473,921 B2 * 11/2002 Brooke et al. ..... 5/600
7,386,900 B2 * 6/2008 Lemire ..... 5/611
2007/0226907 A1 * 10/2007 Dorenbeck ..... 5/611
* cited by examiner

*Primary Examiner* — Michael Trettel
(74) *Attorney, Agent, or Firm* — Henry I. Schanzer

(57) ABSTRACT

A bed is described having a support member for supporting an individual thereon; a base member configured to support the support member above a surface; a primary height adjusting mechanism operable to adjust the height of the support member with respect to the base member. The primary height adjusting mechanism includes an arrangement of a plurality of link arms drivably coupled to one or more actuators which raises the support frame member. During raising of the support frame member from its lowermost position to its fully raised position there is an initial lifting stage when the lifting force applied by the associated actuator to the arrangement of link arms acts at a shorter distance from a fulcrum of the arrangement of link arms to the support frame and therefore with a greater moment of force than during a later stage of lifting movement. A secondary height adjusting mechanism is operable to adjust the height of the base member with respect to the surface.

21 Claims, 9 Drawing Sheets

HIGH/LOW BED

CROSS REFERENCE TO RELATED APPLICATION

This application claims priority from Australian patent application 2008202116 filed 13 May 2008 titled "High/Low Bed", whose teachings are fully incorporated herein.

FIELD OF THE INVENTION

The present application relates to a bed, and in particular, to a height adjustable high/low bed for use in a hospital or care facility.

BACKGROUND OF THE INVENTION

Some beds used in hospital and care facilities, such as care facilities for the aged and or disabled, are adjustable in both height and contour. Such beds comprise a patient support that supports a mattress, upon which the patient lies. The height level of the patient support is adjustable between accepted limits by drive system controllable by the patient or a health-care worker. The patient support is divided into a plurality of sections, including a head section, a torso section and a leg section. The various sections are selectively movable with respect to each other by one or more controllable drive mechanisms to facilitate angular adjustability that enables the patient supported thereon to assume a variety of positions so as to improve patient comfort and/or to facilitate treatment.

In hospitals and nursing homes providing care for the elderly and/or individuals suffering from dementia and the like, conventional hospital beds have considerable drawbacks. Often, such individuals have limited movement and limited control over their movement, and can be prone to periods of confusion either due to their condition, or influenced by medication they may be taking. In such instances, it is not uncommon for individuals to fall from their beds and suffer injuries, even where their conventional hospital beds are placed in their lowered positions.

Whilst rails and the like have been proposed to assist in retaining the individual on the bed, the use of rails and other such enclosures has been known to cause injury, and in sometimes even death, when the individual has become entangled in the rails.

In order to address such problems, it has been proposed to provide high/low beds for use with individuals prone to falling from their beds. Such high/low beds provide greater vertical adjustability than conventional hospital beds as the height of the bed can be lowered to a level that is approaching the level of the floor. With such beds, should the individual fall from the bed to the floor, he is unlikely to sustain significant injury. These beds do not need protective rails around the bed, and hence reduce the possibility of strangulation and limb breakage should the individual become entangled in such rails.

As high/low beds require a large degree of vertical movement to move the bed between a position that is approaching the floor and a conventional elevated bed position, conventional high/low beds have required a dedicated height adjustment mechanism located underneath the bed. Such a mechanism is controllable to raise and/or lower the bed as desired. In this regard, the bed may be lowered at night to reduce the chance of injury should the individual fall out of the bed, and may be raised during awake periods.

A problem with such high/low beds having the height adjusting mechanism located underneath the bed, is that there is minimal clearance underneath the bed to accommodate a patient-lifting device. In this regard, due to various health and safety regulations, most hospital and nursing homes provide a dedicated patient lifting device in the event that an individual falls from a bed or requires lifting from the bed to perform everyday functions. Conventional patient lifting devices employ a cradle-type system to be located around the patient and a hoist to elevate the patient onto the bed. As the patient-lifting device requires at least partial accommodation under the bed during use, the lack of clearance under a conventional high/low bed prevents use of such a device. Where such high/low beds provide a clearance to accommodate a patient-lifting device, the height of the bed in its lowest position is still high enough to provide significant risk of injury to an individual falling therefrom.

To overcome this deficiency in high/low beds, beds commonly referred to as floor beds have been proposed. Such floor beds are also capable of being raised/lowered between an elevated position and a position adjacent the floor, and employ screw mechanisms at the head and foot of the bed to elevate/lower the patient support. In this regard, most floor beds comprise columns located at the head and foot of the bed, which accommodate the screw mechanisms for raising and lowering the patient support. Such conventional floor beds are typically visually distinctive and are readily identified as a hospital bed, lacking the aesthetics of a conventional or "home-style" bed. The columns at the head and foot of the bed allow little scope to improve the aesthetics.

The above references to and descriptions of prior proposals or products are not intended to be, and are not to be construed as, statements or admissions of common general knowledge in the art.

It is an object of the present invention to provide a high/low bed that can locate a patient close to the floor so as to reduce the likelihood of injury in the event of the patient falling from the bed.

A preferred object is to provide a bed that can be aesthetically pleasing and which can be relatively simply adapted for use with conventional patient lifting devices and other such equipment, as required.

SUMMARY OF THE INVENTION

According to a first aspect of the present invention there is provided a bed comprising:

a support member for supporting an individual thereon;

a base member configured to support the support member above a floor surface;

a primary height adjusting mechanism selectively operable to adjust the height of the support member with respect to the base member; and a secondary height adjusting mechanism selectively operable to adjust the height of the base member with respect to the floor surface.

Preferably the secondary height adjusting mechanism is selectively operable independently of the primary height adjusting mechanism.

The base member in the preferred embodiment comprises a generally rectangular base frame member. Likewise the support member preferably comprises a generally rectangular support frame member and the base frame member is arranged to support the support frame member thereon when the bed is in a lowered position. Preferably, when the bed is in the lowered position, the primary height adjusting mechanism and the secondary height adjusting mechanism are contained within the base frame member. For this purpose, the base frame member may include two spaced parallel side rails, and the primary height adjusting mechanism includes a lifting link arrangement which, when the bed is in the lowered position, lies closely adjacent one of said side rails so as not to project substantially above or below the respective side rail.

Preferably the primary height adjusting mechanism provides a connection between a base frame member of the base member and a support frame member of the support member. The primary height adjusting mechanism may include an arrangement of a plurality of link arms drivably coupled to one or more actuators operable to selectively raise the support frame member with respect to the base frame member. For example, the arrangement of link arms may be configured so that, during raising of the support frame member from its lowermost position to its fully raised position above the base frame member, during an initial lifting stage the lifting force applied by the associated actuator to the arrangement of link arms acts at a shorter distance from a fulcrum of the arrangement of link arms to the support frame and therefore with a greater moment of force than during a later stage of lifting movement.

In the preferred embodiment, the arrangement of link arms includes a primary link arm pivotally movable about one end coupled to the base frame member at the fulcrum, the primary link arm being pivotally mounted at its other movable end to a secondary link arm at a point between the opposite ends of the secondary link arm, one first end of the secondary link arm being pivotally mounted to the support frame member and the other second end of the secondary link arm being coupled to the base frame member by an anchor member extending from an anchor point of the base frame member spaced from the fulcrum with the anchor member allowing some lost motion between the anchor member and the second end of the secondary link arm during the first stage of lifting movement and, upon reaching the limit of the lost motion, the anchor member restrains the second end of the secondary link arm to prevent further movement of that second end away from the anchor point. In this embodiment the anchor member coupling the second end of the secondary link arm to the base frame member may comprise an anchor link providing a pivotal coupling between the second end of the secondary link arm and the anchor link, the pivotal coupling having a pivot pin both pivotally and longitudinally movable within a pivot slot during the first stage of movement of the primary height adjusting mechanism.

In one embodiment, during the first stage of movement of the primary height adjusting mechanism, the secondary link arm may extend along and bear against an underside of the support frame member at points along a substantial part of the length of the secondary link arm so as to apply lifting force to the support frame member along a substantial part of the length of the secondary link arm, and whereby after the end of the first stage of lifting movement, the second end of the secondary link arm relatively moves downwardly away from the underside of the support frame member and the lifting force applied by the pivoting and lifting movement of the primary link arm is transmitted to the first end of the secondary link arm to apply lifting force to the support frame member substantially at the point of coupling of the first end of the secondary link arm to the support frame member.

Preferably one or more actuators include a selectively operable drive actuator coupled to a drive crank fixed relative to the primary link arm so as to rotate the primary link arm about its pivotal mounting to the base frame member at the fulcrum. In this embodiment, when the support frame member is in its lowermost position, the drive actuator and the drive crank to which it is coupled preferably are contained within the base frame member.

The secondary height adjusting mechanism may comprise a plurality of legs extendible from an underside of the base frame member. The secondary height adjusting mechanism is preferably operable such that each leg is movable between a retracted position wherein each leg is lifted from the floor surface and an extended position wherein each leg is in contact with the floor surface. When the legs of the secondary height adjusting mechanism are in their extended positions, the base member is supported above the floor surface by the plurality of legs, such that the height of the base member above the floor surface is determined by the lengths of the legs and that height is preferably sufficient to accommodate a base of a patient lifting device.

The secondary height adjusting mechanism may include a pair of shafts rotatably mounted to the base frame member at opposing ends thereof, each of the shafts having a plurality of legs mounted thereto, and wherein an actuator device is selectively operable to rotate the shafts to move the legs between their retracted and extended positions. The actuator device is preferably a linear actuator having a reciprocating drive rod drivingly coupled to a drive crank associated with at least one of the shafts.

According to a second aspect of the present invention, there is provided a bed comprising:

a support member for supporting an individual thereon and having a support frame member;

a base member configured to support the support member above a floor surface and having a base frame member; and a primary height adjusting mechanism providing a connection between the base frame member and the support frame member and being selectively operable to adjust the height of the support member with respect to the base member;

wherein the primary height adjusting mechanism includes an arrangement of a plurality of link arms drivably coupled to one or more actuators operable to selectively raise the support frame member with respect to the base frame member, said arrangement of link arms being configured so that, during raising of the support frame member from its lowermost position to its fully raised position above the base frame member, during an initial lifting stage the lifting force applied by the associated actuator to the arrangement of link arms acts at a shorter distance from a fulcrum of the arrangement of link arms to the support frame and therefore with a greater moment of force than during a later stage of lifting movement.

When used in this specification and claims, the terms "comprises" and "comprising" and variations thereof mean that the specified features, steps or integers are included. The terms are not to be interpreted to exclude the presence of other features, steps or components.

BRIEF DESCRIPTION OF THE DRAWINGS

By way of example only, the invention is now described with reference to the accompanying drawings.

DETAILED DESCRIPTION OF AN EXEMPLARY EMBODIMENT OF THE INVENTION

Figure 1:
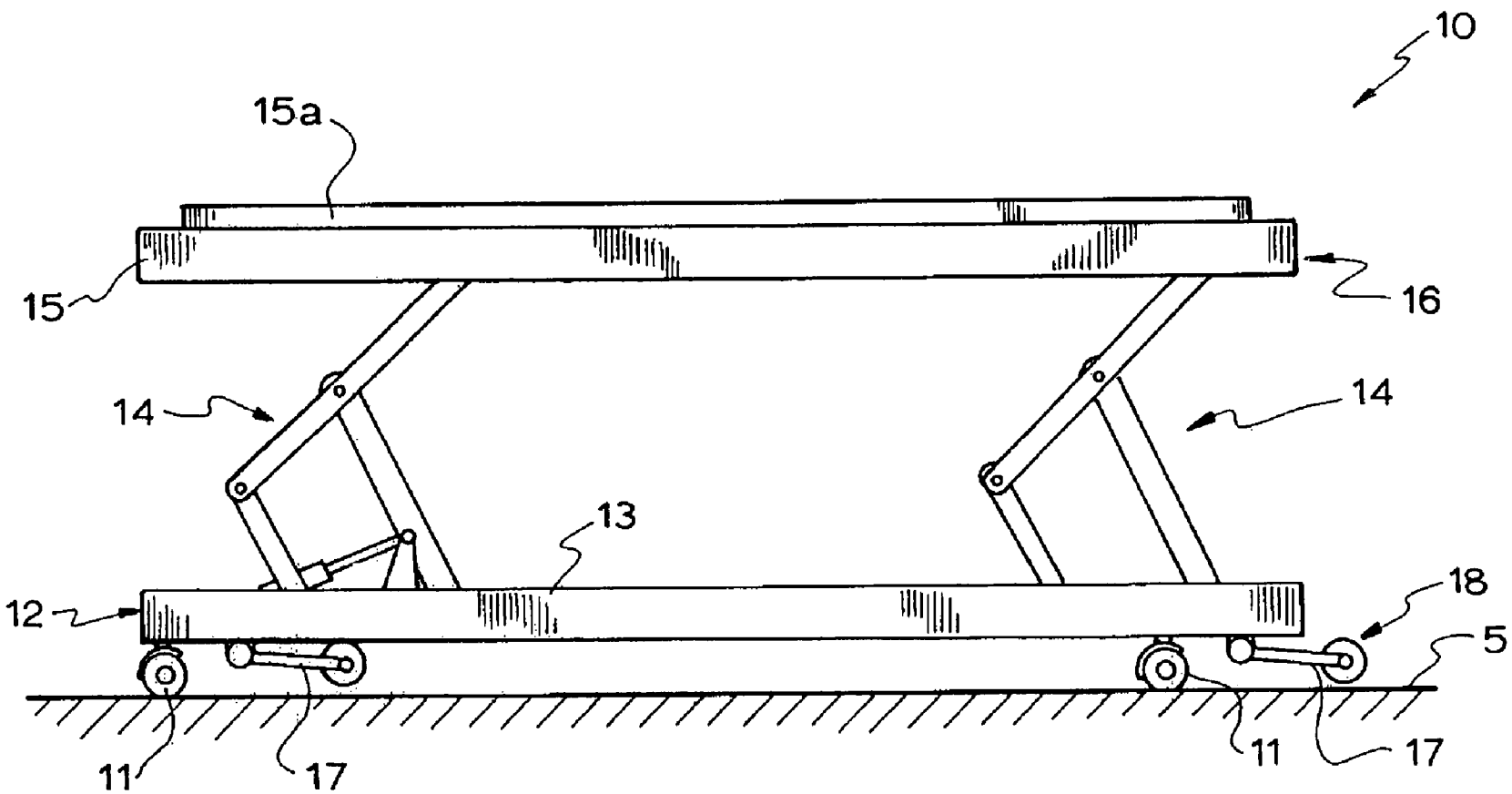
FIG. 1 is a side view of a high/low bed in accordance with an embodiment of the present invention.

Referring to the accompanying drawings, the high/low bed 10 of the present invention comprises a base 12 having a substantially rectangular frame member 13, in combination with a patient support 16, also having a substantially rectangular frame member 15. As is shown in FIG. 1, the patient support 16 is height adjustable with respect to the base 12 by a primary height adjustment mechanism 14. The bed 10 can be selectively adjusted between a conventional raised position (FIG. 1) and a lowered position adjacent the floor 5 (FIG. 2) so as to reduce the risk and/or severity of injury to a patient falling from the bed 10.

The frame member 15 of the patient support 16 supports a plurality of platforms or slats (not shown) that support a mattress 15*a* or the like upon which a patient lies. Whilst not shown, the frame member 15 of the patient support 16 may also house one or more drive mechanisms to facilitate contour control of the mattress 15*a*, as is known in the art. It will be appreciated that the various components that facilitate contour control of the mattress 15*a* will be contained within the frame member 15 of the patient support 16.

The frame member 13 of the base 12 is supported above a floor surface 5 by castors 11, or the like, that enable the bed 10 to be moved, as desired. The castors 11 are disposed on the underside of the four corners of the frame member 13 and are configured such that the underside of the frame member 13 is located close to the floor surface 5.

Figure 2:
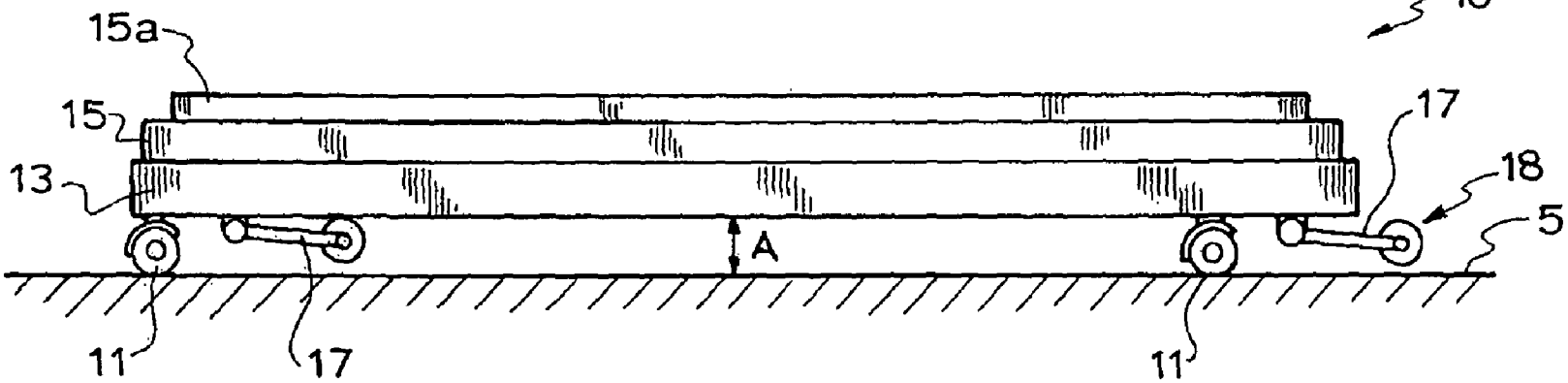
FIG. 2 is a side view of the high/low bed of FIG. 1 in a lowered position.

The primary height adjustment mechanism 14 operates between the frame member 13 of the base 12 and the frame member 15 of the patient support 16. When the bed 10 is in a lowered position, as shown in FIG. 2, the height adjustment mechanism 14 is substantially contained within the frame member 13 of the base 12. In such a position the frame member 15 is supported on the frame member 13 of the base 12, thereby minimising the height of the mattress 15*a* above the floor 5.

As is shown in FIG. 2, when the bed 10 is in the lowered position, it is suitable for supporting a patient in a relatively safe manner. In the event of a patient inadvertently falling off the bed 10, the minimal distance to the floor reduces the likelihood or severity of injury. Should the patient require assistance to return to the bed 10, the patient can be lifted on to the mattress 15*a*, typically using a patient-lifting device.

A patient lifting device is a hoist-type device that safely and securely lifts a patient onto a bed 10, or similar elevated surface. The patient lifting device typically comprises a harness that is fitted about the patient and a mechanical hoist arrangement that lifts the patient onto the bed. Such devices typically comprise a base portion that extends therefrom to stabilise the device during use. The base portion is typically provided with wheels such that the base portion can be rolled under the bed 10 to lift the patient onto the bed 10, if desired. As will be appreciated in FIG. 2, as the bed 10 is configured to be located as close to the floor 5 as possible, there is insufficient clearance 'A' below the bed 10 to accommodate a base of a patient-lifting device. In the embodiment as shown, clearance 'A' is typically in the region of between 0-50 mm, preferably around 40 mm.

In order to accommodate a patient-lifting device, a minimum clearance of 150 mm under the bed 10 is considered necessary. To provide this clearance whilst maintaining the bed 10 as close to the floor as possible, the bed 10 has an auxiliary height adjustment mechanism 18.

The auxiliary height adjustment mechanism 18 illustrated comprises legs 17 located adjacent the underside of the four corners of the frame member 13. The legs 17 are simultaneously actuated to raise the bed 10 from the lowered position (FIG. 2) to an intermediate position (FIG. 3) creating a clearance 'B' sufficient to accommodate a patient-lifting device. The size of clearance 'B' is typically dictated by the devices with which the bed is to be used. In a preferred embodiment, the clearance 'B' is around 160 mm to accommodate a patient-lifting having a base height of around 150 mm. If a patient requires lifting from the floor 5 to the bed 10 using a patient lifting device, the bed 10 can be lifted to the intermediate position by merely actuating the legs 17 into position as is shown in FIG. 3.

Figure 3:
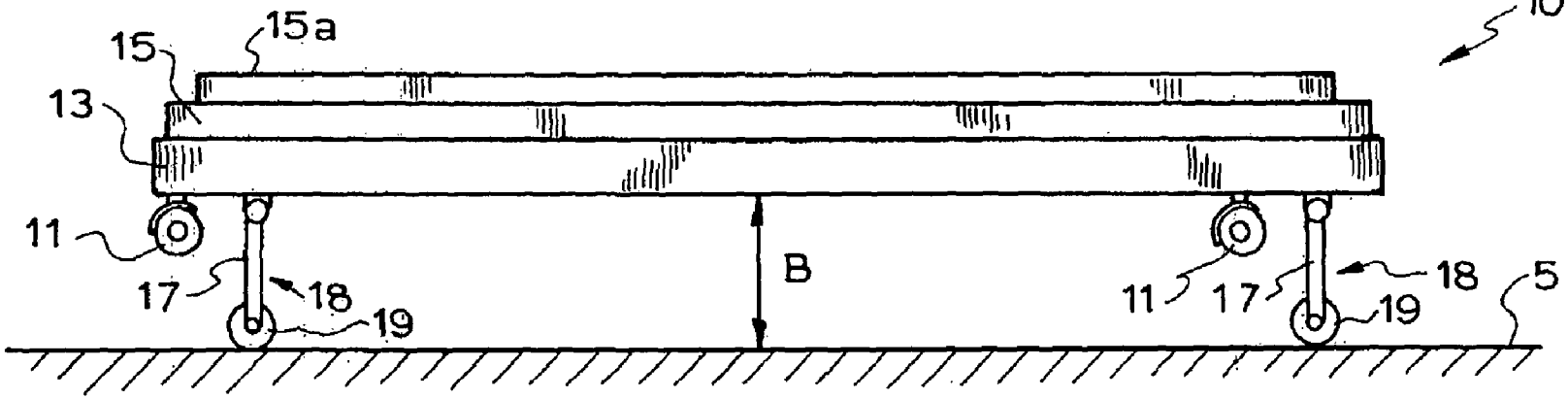
FIG. 3 is a side view of the high/low bed of FIGS. 1 and 2 in an intermediate raised position in accordance with an embodiment of the present invention.

In the embodiment shown, legs 17 have wheels 19 provided at the ends thereof such that when actuated, the legs 17 roll into position shown in FIG. 3 with reduced friction. The wheels 19 can be omnidirectional such that the bed 10 in the intermediate position can be moved back and forth. It will be appreciated that the legs 17 need not have wheels 19 to achieve their auxiliary lifting function and other arrangements are also envisaged.

Figure 4:
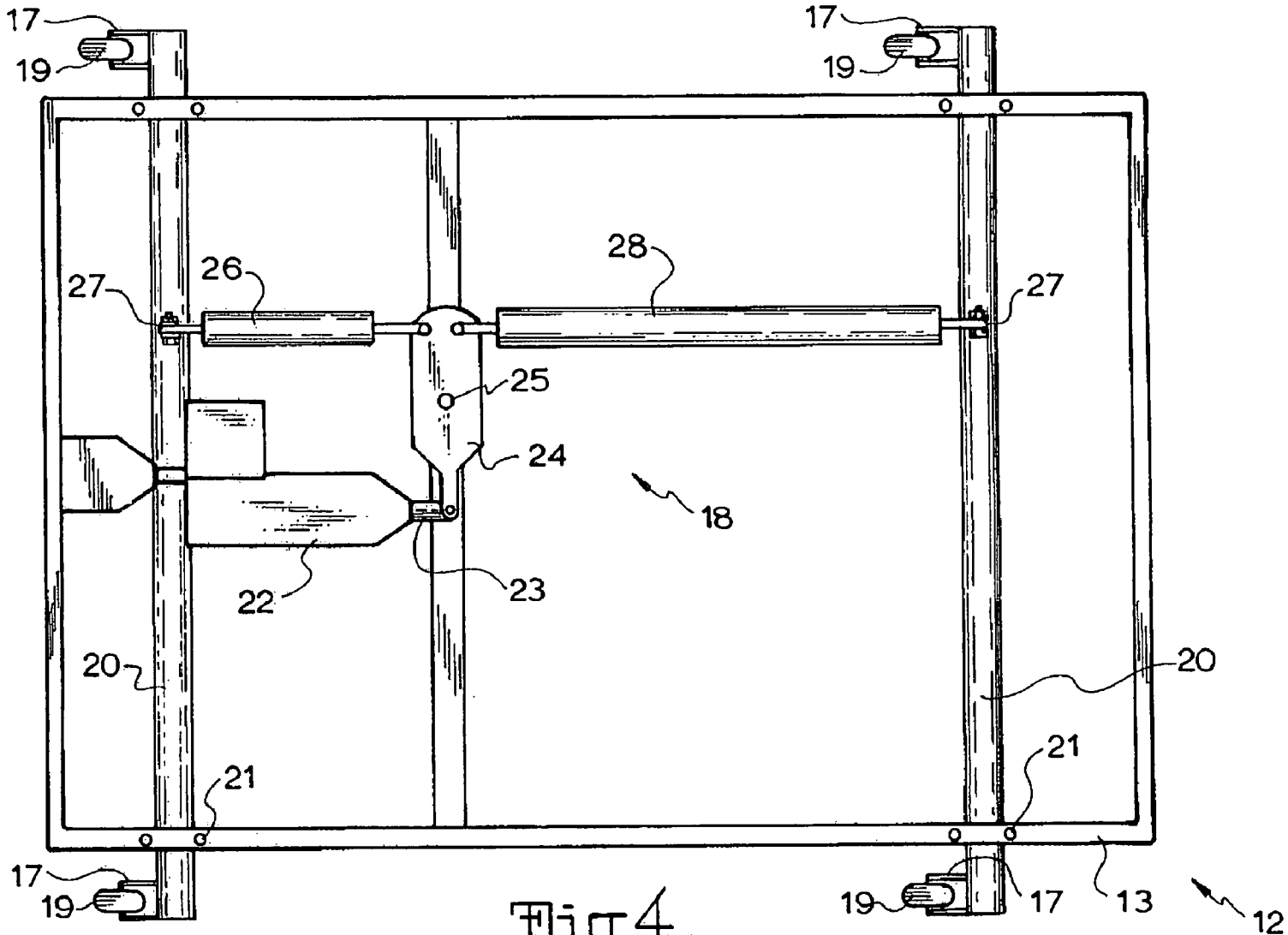
FIG. 4 is a top view of an auxiliary height adjustment mechanism in accordance with an embodiment of the present invention, with the high/low bed being in the lowered position of FIG. 2.
Figure 5:
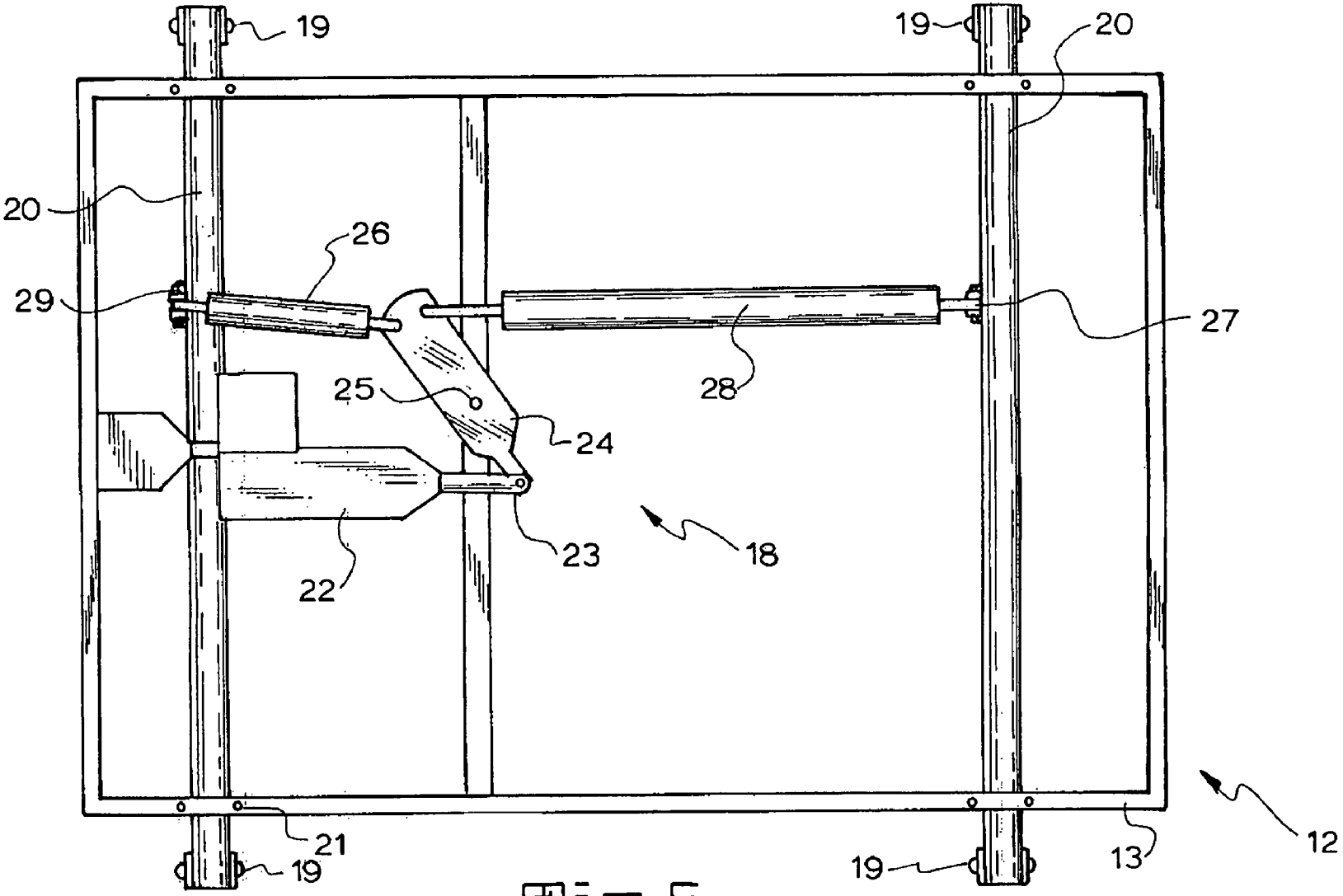
FIG. 5 is a top view of an auxiliary height adjustment mechanism in accordance with an embodiment of the present invention, with the high/low bed being in the intermediate raised position of FIG. 3.

Referring to FIGS. 4 and 5, the manner in which the auxiliary height adjustment mechanism 18 functions is shown. A pair of legs 17 are mounted to opposing ends of each of a pair of shafts 20. The shafts 20 are mounted at opposing ends of the underside of the frame 13 by brackets 21 which enable the shafts 20 to rotate as desired. When the auxiliary height adjustment mechanism 18 is not actuated, the retracted legs extend substantially horizontally with respect to the frame 13 as shown in FIGS. 2 and 4. When the auxiliary height adjustment mechanism 18 is actuated, the extended legs extend vertically from the frame 13 to contact the floor 5 and elevate the underside of the frame 13 from the floor 5, in the manner to be described below.

An actuator 22, such as a LINAK™ linear actuator, is mounted at an end of the frame 13. A reciprocating rod 23 of the actuator 22 is connected at a distal end thereof to one end of a pivot plate 24. The pivot plate 24 is mounted to the frame 13 at a pivot point 25 about which the plate 24 pivots upon reciprocation of the actuator rod 23.

Connecting rods 26, 28 extend between respective ones of the shafts 20 and an end of the pivot plate 24. Both the first and second connecting rods 26, 28 are pivotally coupled to the pivot plate 24 by respective pins, bolts or the like. The opposite remote ends of the first and second connecting rods 26, 28 are connected to crank arms or lugs 27, 29 on the periphery of the shafts 20.

In this arrangement, upon activation of the actuator 22 by way of an appropriate controller, such as a control switch or the like, the reciprocating rod 23 of the actuator 22 is caused to extend from the actuator, from the retracted position (FIG. 4). As the reciprocating rod 23 extends, it applies a pushing force to the pivot plate 24, causing the plate 24 to rotate about pivot point 25. The pushing motion of the rod 23 results in the plate 24 applying a pushing force to first connecting rod 26 and a corresponding pulling force to second connecting rod 28. The pushing force of first connecting rod 26 to its shaft 20 results in the shaft rotating such that the associated legs 17 rotate from the frame 13 into contact with the floor 5. Similarly, the corresponding pulling force of second connecting rod 28 to its shaft 20 results in that shaft rotating such that its associated legs 17 rotate from the frame 13 into contact with the floor 5. This causes the underside of the base 12 of the bed 10 to be raised from the floor surface 5 in the manner as shown in FIGS. 3 and 5.

Reverse activation of the actuator 22 will result in the rod 23 being retracted back into the actuator 22. This causes a reversal of forces acting on the shafts 20 by way of connecting rods 26, 28, such that the shafts will rotate back into the position as shown in FIGS. 2 and 4. In this position, the bed 10 is returned to its lowest configuration, such that the underside of the frame 13 is at or adjacent the level of the floor 5.

The provision of the auxiliary height adjustment mechanism 18 with the bed 10 enables the bed 10 to be readily and simply adapted for use with conventional patient lifting devices and other such equipment, as required. This can be achieved without the need to alter the vertical relationship between the base 12 and the patient support 16, which may be set to specific patient requirements. Such an arrangement also ensures that the bed 10, in its lowered position, is as close to the floor as possible, as there is no need to accommodate a conventional patient lifting devices and other such equipment in such a position. To accommodate such a device the bed 10 is merely raised to the intermediate position (FIG. 3) to achieve the lifting, after which the bed can be simply returned to its lowered position (FIG. 2).

Figure 6:
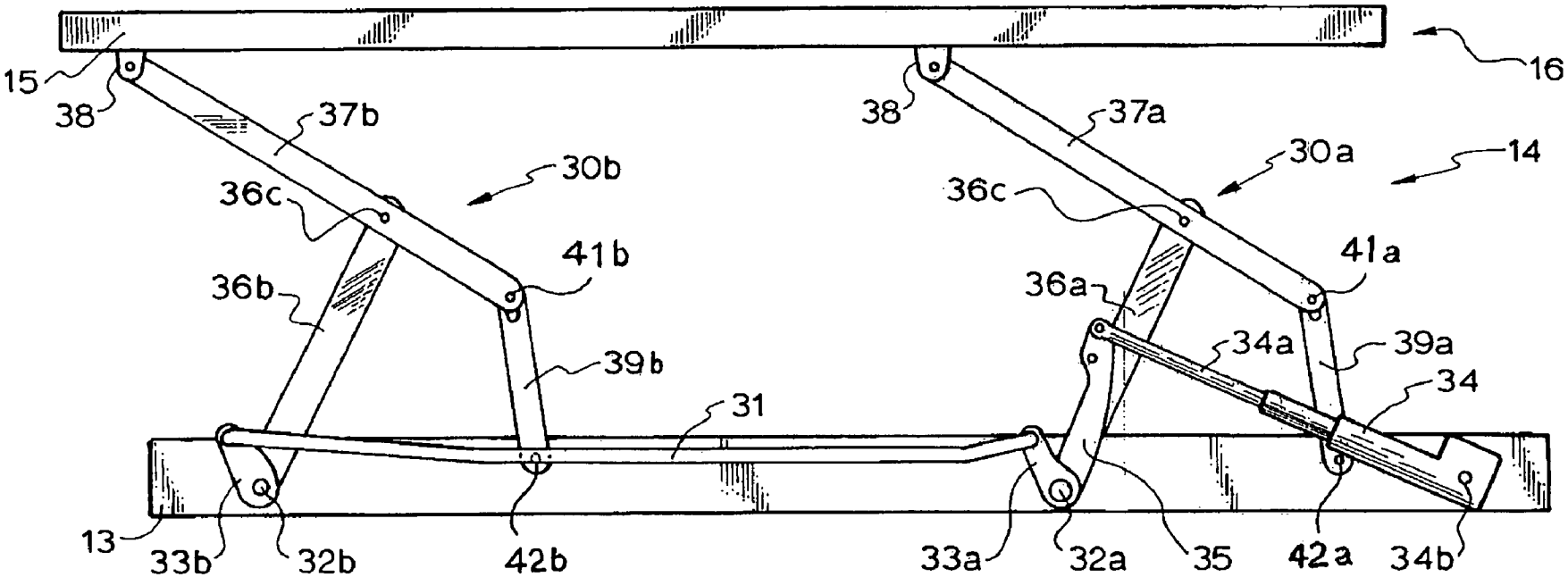
FIG. 6 is a side view of the high/low bed of FIGS. 1-3 showing an embodiment of the primary height adjustment mechanism.
Figure 7:
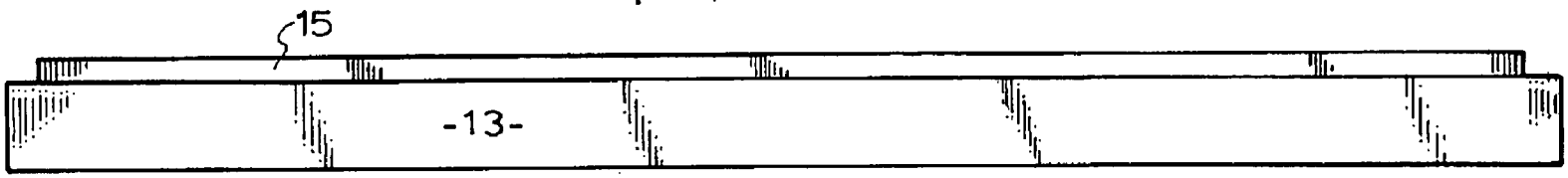
FIG. 7 is a side view of the high/low bed with the primary height adjustment mechanism of FIG. 6 in a lowered position.

Referring to FIGS. 6 and 7, one possible embodiment of the primary height adjustment mechanism 14 of FIG. 1 is shown in detail. As previously discussed, the height adjustment mechanism 14 links the frame member 13 of the base 12 and the frame member 15 of the patient support 16 such that the bed 10 can be moved between a lowered position (FIG. 7) and an elevated position (FIG. 6). As previously discussed, each component of the height adjustment mechanism 14 is configured such that it is contained within the frame member 13 of the base 12 when the bed 10 is in the lowered position.

Referring to FIG. 6, the height adjustment mechanism 14 comprises two substantially identical link arrangements 30*a*, 30*b* coupled together by a connecting rod 31. The link arrangements 30*a*, 30*b* are positioned along each side of the bed 10, however, for reasons of clarity, only two link arrangements 30*a*, 30*b* are shown. It will be appreciated that the bed 10 typically requires four link arrangements to perform the height adjusting function.

In the embodiment as shown, each link arrangement 30*a*, 30*b* is mounted to a shaft member 32*a*, 32*b* that extends across the frame member 13. The connecting rod 31 extends between crank two arms 33*a*, 33*b*. The crank arms 33*a*, 33*b* are each securely mounted on a respective shaft member 32*a*, 32*b* such that rotational movement applied to shaft member 32*a* is also applied to shaft member 32*b*.

A linear actuator 34 having a reciprocating rod 34*a* is pivotally mounted to frame member 13 at pivot point 34*b*. The linear actuator 34 is operable to apply either a pushing or pulling force to a crank or lever arm 35 as the rod 34*a* reciprocates. The lever arm 35 is mounted on shaft member 32*a* such that the force applied thereto by the rod 34*a* rotates the shaft member 32*a*. Primary link arms 36*a* and 36*b* are also securely mounted at respective proximal ends to shafts 32*a*, 32*b* respectively so that shaft members 32*a*, 32*b* act as fulcrums for force applied by actuator rod 34*a* to shafts 32*a*, 32*b*. Arms 36*a*, 36*b* are pivotally mounted at respective distal ends to secondary link arms 37*a*, 37*b* respectively at pivot point 36*c*. The secondary link arms 37*a*, 37*b* are pivotally connected to the frame member 15 of the patient support 16 at a first end 37*c*, 37*e* by way of lugs 38 extending from the underside of the frame member 15. The second ends 37*d*, 37*f* of the secondary link arms 37*a*, 37*b* are connected at anchor points 43*a*, 43*b* to the frame member 13 of the base 12 by way of intermediate link or anchor members 39*a*, 39*b*, respectively.

Figure 13A:
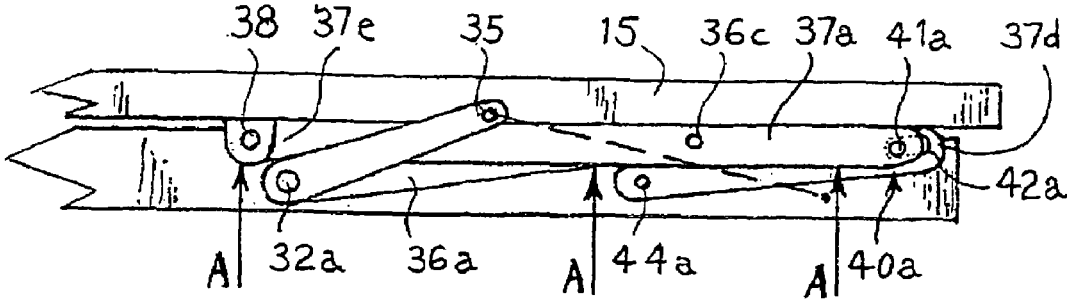
FIGS. 13*a* to 13*c* show schematically details of the linkage arrangement of the primary height adjusting mechanism and its two stage operation.
Figure 13B:
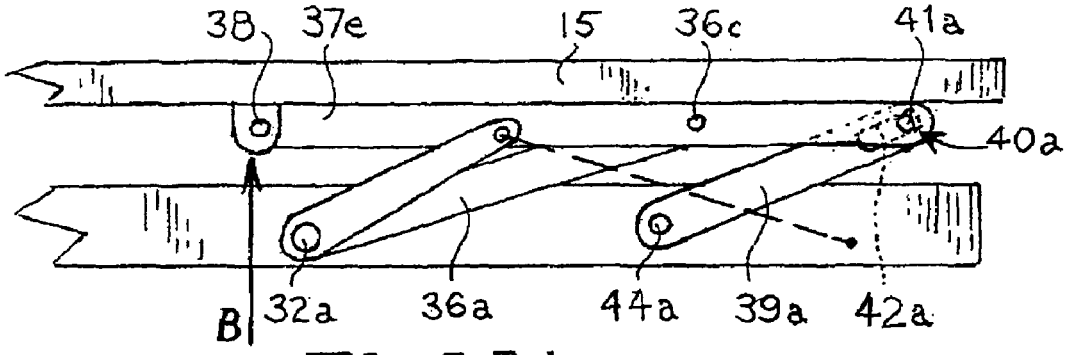
Figure 13C:
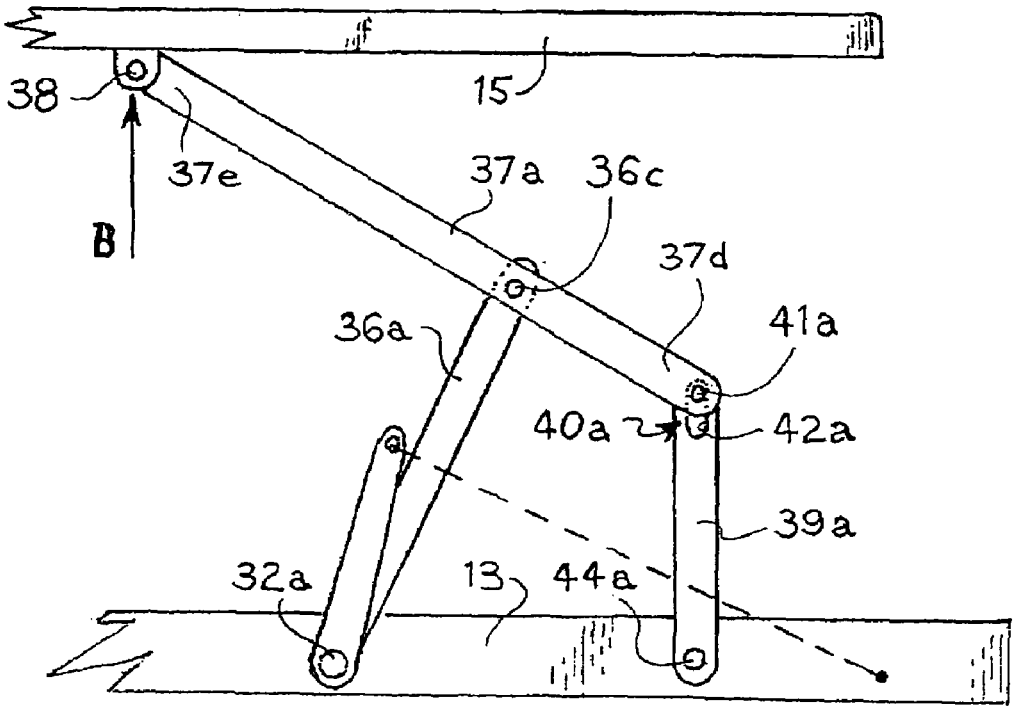

The second end 37*d*, 37*f* of the secondary link arms 37*a*, 37*b* are coupled to the base frame member by the anchor members 39*a*, 39*b* extending from the anchor points 43*a*, 43*b* of the base frame member 13 spaced from the fulcrum 32*a*, 32*b*. Each anchor member 39*a*, 39*b* allows some lost motion between the anchor member and the second end of the secondary link arm during the first stage of lifting movement and, upon reaching the limit of the lost motion, the anchor member 39*a*, 39*b* restrains the second end of the secondary link arm 37*a*, 37*b* to prevent further movement of that second end 37*d*, 37*f* away from the anchor point 43*a*, 43*b*. As shown in FIGS. 13*a* to 13*c* each anchor 39*a*, 39*b* member coupling the second end of the secondary link arm to the base frame member 13 comprises an anchor link providing a pivotal coupling 40*a*, 40*b* between the second end 37*d*, 37*f* of the secondary link arm 37*a*, 37*b* and the anchor link, the pivotal coupling having a pivot pin 41*a*, 41*b* both pivotally and longitudinally movable within a pivot slot 42*a*, 42*b* during the first stage of movement of the primary height adjusting mechanism. Instead of anchor links as illustrated, anchor tethers such as short chains or wires may be used to extend between points 41*a*and 42*a*.

Also as best seen in FIGS. 13*a* and 13*b*, during the first stage of movement of the primary height adjusting mechanism, the secondary link arm 37*a* extends along and bears against an underside of the support frame member 15 at points along a substantial part of the length of the secondary link arm 37*a* so as to apply lifting force A to the support frame member along a substantial part of the length of the secondary link arm. After the end of the first stage of lifting movement depicted in FIG. 13*b*, the second end 37*d* of the secondary link arm 37*a* relatively moves downwardly away from the underside of the support frame member 15 and the lifting force B applied by the pivoting and lifting movement of the primary link arm 36*a* is transmitted to the first end 37*e* of the secondary link arm 37*a* to apply lifting force B to the support frame member 15 substantially at the point of coupling 38 of the first end of the secondary link arm to the support frame member.

Figure 8:
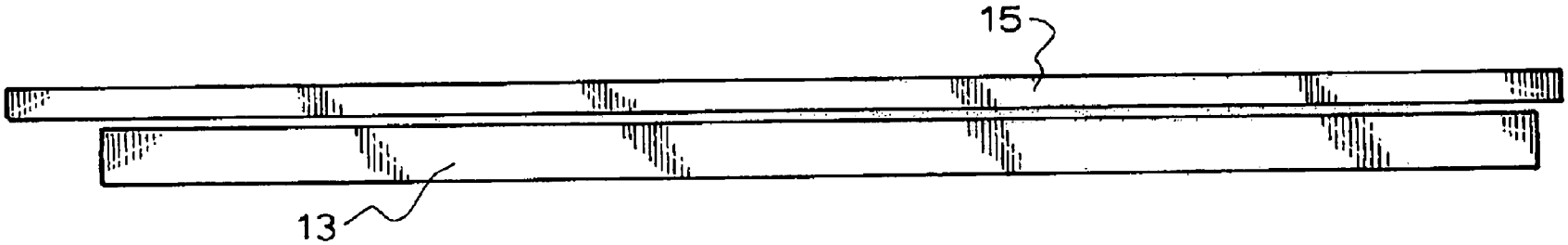
FIG. 8 is a side view of an embodiment of the high/low bed of the present invention with the frame members of the base and the patient support in a lowered position.

As depicted in FIG. 8, when the bed is in the lowered position, frame member 15 is positioned on frame member 13 such that the actuator 34 and the link arrangements 30*a*, 30*b* are contained within the frame member 13. As shown in FIG.

11 and 13*a*, in this retracted position, the actuator 34 and the corresponding crank or lever arm 35 are at a large obtuse angle to each other, e.g. about 150°. Due to this orientation of the actuator 34 and the lever arm 35 there is little leverage available and so a significant amount of force is required by the actuator 34 if that force is to be sufficient during the initial lifting stage.

Figure 9:
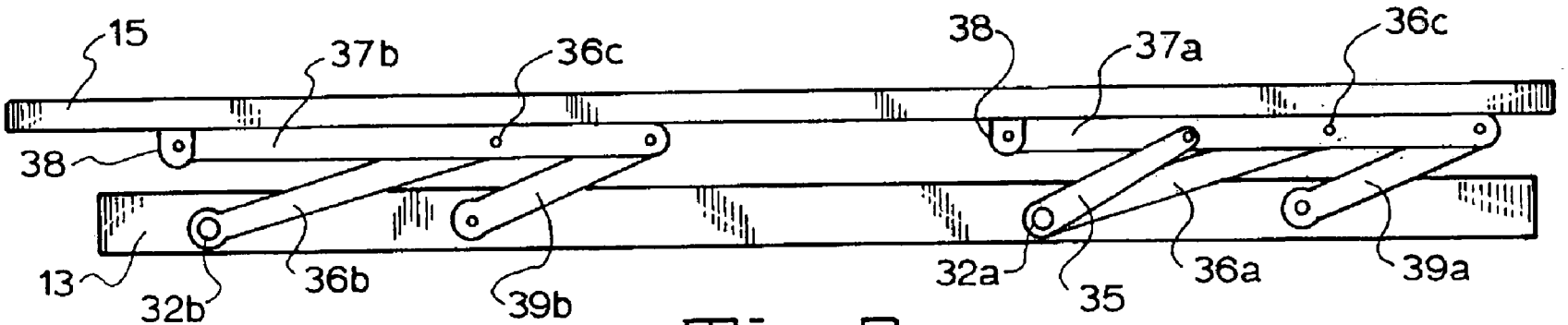
FIG. 9 is a cross-sectional side view of the primary height adjustment mechanism in a first lifting stage.

Upon activation of the actuator 34, the rod 34*a* is caused to extend therefrom, applying a pushing force against the crank or lever arm 35. The shaft 32*a* is then caused to rotate under this pushing force, causing the primary link arm 36*a* to also rotate upwardly, thereby causing the support frame member 15 to be raised from the base frame member 13, as is shown in FIGS. 9 and 13*b*.

During this initial or first lifting stage, it is the action of the primary link arms 36*a*, 36*b*, which extend from the shafts 32*a*, 32*b* to the pivot point 36*c*, that lifts the support frame member 15. This relatively short leverage distance of the primary link arms 36*a*, 36*b* provides compensation for the relatively large amount of force required by the actuator 34 to initiate the lifting action, as discussed above. The secondary link arm 37*a* is substantially horizontal bearing against the underside of the frame member 15, it is passive in providing any lifting function during this first or initial lifting stage.

Figure 10:
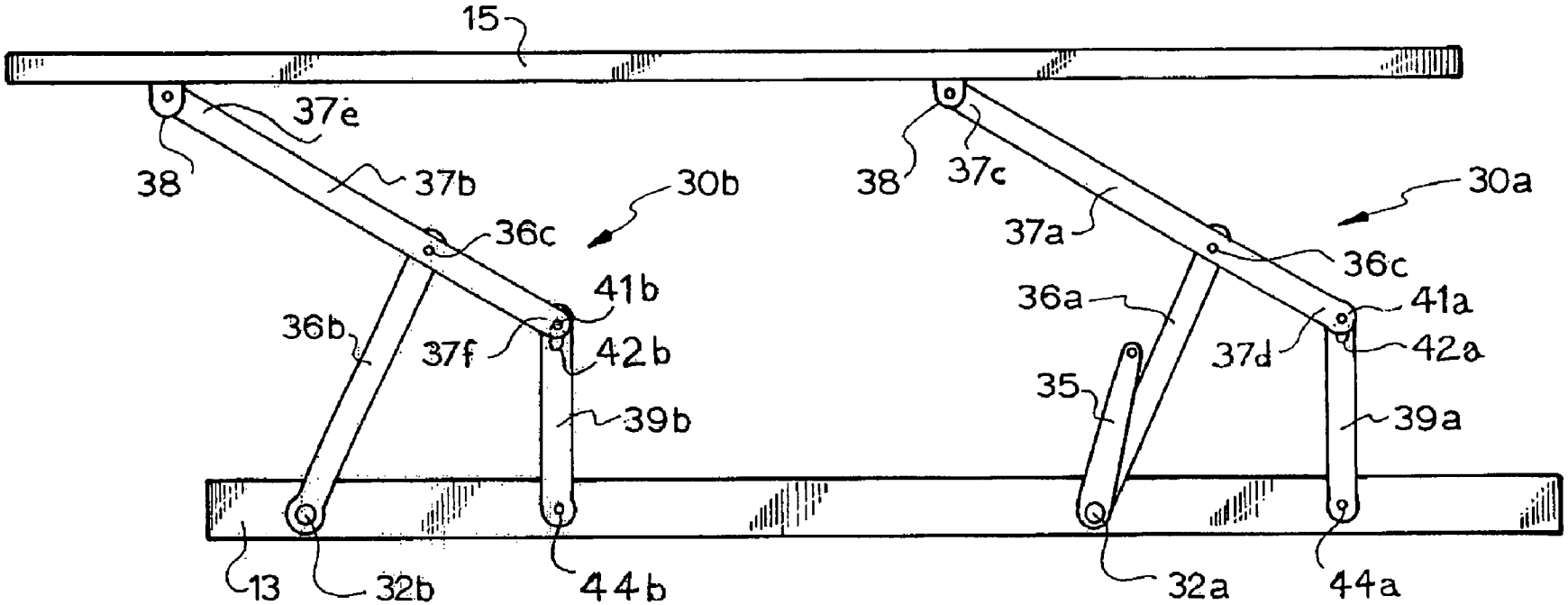
FIG. 10 is a cross-sectional side view of the primary height adjustment mechanism of FIG. 9 in a final or second lifting stage.
Figure 11:
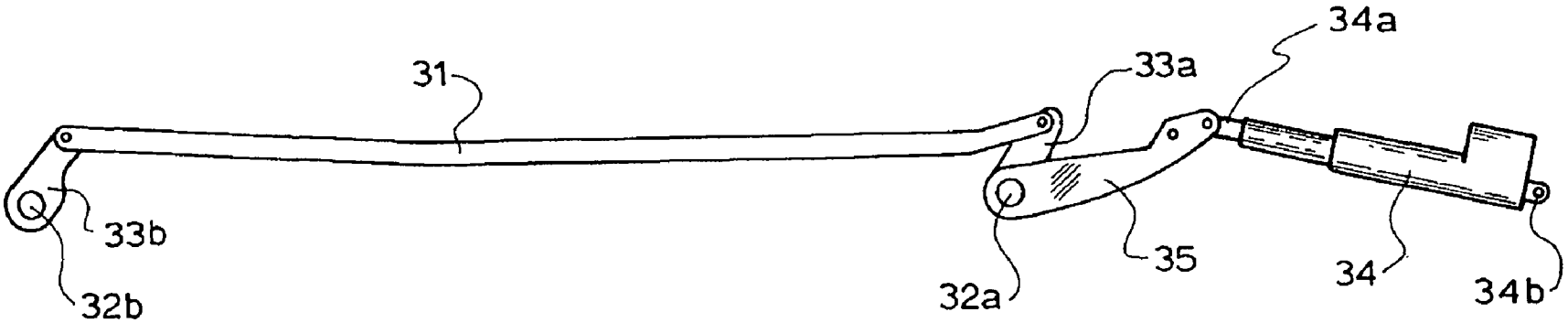
FIG. 11 is a side view of an embodiment of the actuator and lever arm of the primary height adjustment mechanism of FIG. 9 during a first or initial lifting stage.

The second lifting stage starts from the point shown in FIG. 13*b* when the anchor members 39*a*, 39*b* restrain the second ends 37*d*, 37*f* so that the secondary link arms 37*a*, 37*b* pivot beyond horizontal and therefore transfer lifting forces B to the frame member 15 (FIG. 10). This lifting force B is applied to the frame member 15 at the region where the secondary link arms 37*a*, 37*b* pivotally link with the lugs 38 of the frame member 15. The intermediate anchor members 39*a*, 39*b* come into effect to constrain further movement of the second ends of the secondary link arms 37*a*, 37*b*. This causes the secondary link arms 37*a*, 37*b* to move towards a vertical orientation about pivot point 36*c*. The lifting distance of the height adjustment mechanism 14 during the second lifting stage is greater that the lifting distance in the first or initial lifting stage. The leverage distance in the second lifting stage comprises the length of the primary link arms 36*a*, 36*b* and the length of the secondary link arms 37*a*, 37*b*, between the pivot point 36*c* and the lug 38.

Figure 12:
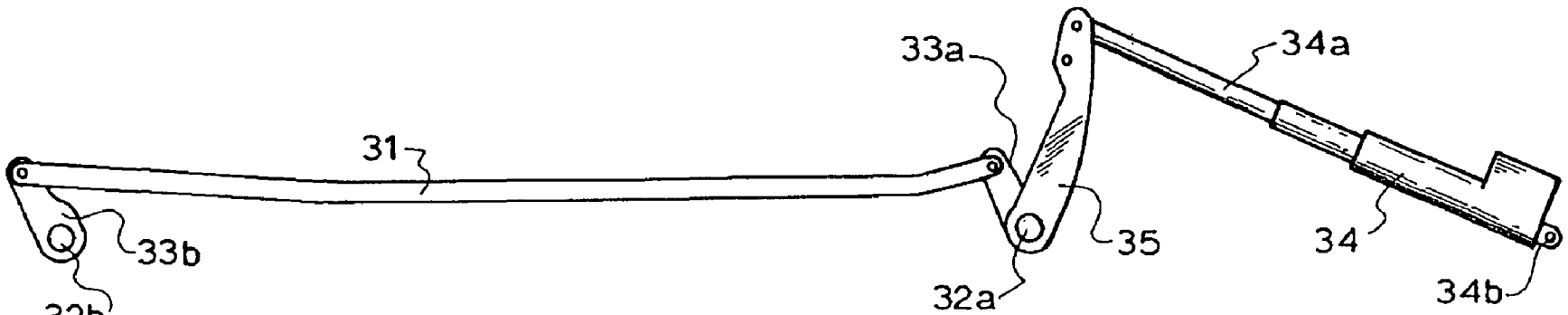
FIG. 12 is a side view of an embodiment of the actuator and lever arm of the primary height adjustment mechanism of FIG. 9 during a second lifting stage.

At this second stage of the lifting process, the angle of orientation between the actuator 34 and the crank or lever arm 35 has changed significantly, as is shown in FIG. 6 or 12. In this regard, the lever arm or crank 35 and the rod 34*a* are orientated closer to right angles ensuring a greater moment of force between the actuator 34 and the crank 35. Therefore whilst the leverage distance of the height adjustment mechanism 14 is greater during the second stage of the lifting process, there is increased mechanical advantage in the lifting force being applied to crank 35 by the actuator 34 to cater for such a change.

Due to the arrangement of the link arrangement 30*a*, which basically comprises a "four-bar chain" defined by 36*a*, 37*a*, 39*a* and the frame member 13 between the pivot connections of 36*a* and 39*a* thereto (i.e. the fulcrum 32*a* and anchor point 42*a*), and the analogous four-bar chain link arrangement 30*b*, further rotation of the shaft 32*a* results in the primary link arm 36*a* bringing the secondary link arms 37*a* towards a more vertical position, thereby raising the frame member 15 of the patient support 16 to its maximum elevation with respect to the frame member 13 of the base 12. The maximum possible elevation would be reached if links 37*a* and 39*a* became collinear, so that at most in this position, but preferably before reaching this position, the actuator 34 ceases operation and is locked in position. Other locking means may be used in replacement of, or in addition to, locking or cessation of operation of this actuator 34, as will be appreciated by those skilled in the art.

To return the bed 10 to its lowered position the actuator 34 is caused to operate to retract the rod 34*a*, as will be appreciated by those skilled in the art.

It will be appreciated that the height adjustment mechanism 14 of the present invention provides an effective means for lifting a high/low bed between a low position and an elevated position whilst ensuring that the mechanism 14 can be compactly retained within the base of the bed 10. The preferred mechanical arrangements described herein provide a two stage lifting process so that the actuator 34 can be effective commencing with the early lifting phase, when the mechanical advantage of the leverage is less than during the later lifting phase. During an initial lifting stage the lifting force A applied by the associated actuator to the arrangement 30*a* of link arms acts at a shorter distance from the fulcrum 32*a* of the arrangement of link arms to the support frame and therefore with a greater moment of force than during a later stage of lifting movement. Such a height adjustment mechanism 14 of the present invention can be completely or at least substantially concealed within the frame member 13 of the base 12 thereby avoiding unsightly lifting columns at the head and foot of the bed 10, allowing for beds having a more aesthetically pleasing design.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What I claim is:

1. A bed comprising:

a support member for supporting an individual thereon, the support member comprising a generally rectangular support frame member;

a base member configured to support the support member above a floor surface, the base member comprising a generally rectangular base frame member, the base frame member being arranged to support the support frame member thereon when the bed is in a lowered position;

a primary height adjusting mechanism selectively operable to adjust the height of the support member with respect to the base member; and a secondary height adjusting mechanism selectively operable independently of the primary height adjusting mechanism to adjust the height of the base member with respect to the floor surface, wherein, when the bed is in the lowered position, the primary height adjusting mechanism and the secondary height adjusting mechanism are contained within the base frame member.

2. A bed according to claim 1 wherein the base frame member includes two spaced parallel side rails, wherein the primary height adjusting mechanism includes a lifting link arrangement which, when the bed is in the lowered position, lies closely adjacent one of said side rails so as not to project substantially above or below the respective side rail.

3. A bed according to claim 1, wherein the primary height adjusting mechanism provides a connection between a base frame member of the base member and a support frame member of the support member.

4. A bed according to claim 3, wherein the primary height adjusting mechanism includes an arrangement of a plurality of link arms drivably coupled to one or more actuators operable to selectively raise the support frame member with respect to the base frame member.

5. A bed according to claim 1, wherein the secondary height adjusting mechanism comprises a plurality of legs extendible from an underside of the base frame member.

6. A bed according to claim 5, wherein the secondary height adjusting mechanism is operable such that each leg is movable between a retracted position wherein each leg is lifted from the floor surface and an extended position wherein each leg is in contact with the floor surface.

7. A bed according to claim 6, wherein when the legs of the secondary height adjusting mechanism are in their extended positions, the base member is supported above the floor surface by the plurality of legs, such that the height of the base member above the floor surface is determined by the lengths of the legs and that height is sufficient to accommodate a base of a patient lifting device.

8. A bed comprising:

a support member for supporting an individual thereon, the support member having a support frame member;

a base member configured to support the support member above a floor surface, the base member having a base frame member;

a primary height adjusting mechanism selectively operable to adjust the height of the support member with respect to the base member, the primary height adjusting mechanism providing a connection between the base frame member of the base member and the support frame member of the support member, the primary height adjusting mechanism comprising an arrangement of a plurality of link arms drivably coupled to one or more actuators operable to selectively raise the support frame member with respect to the base frame member; and a secondary height adjusting mechanism selectively operable to adjust the height of the base member with respect to the floor surface;

wherein said arrangement of link arms is configured so that, during raising of the support frame member from its lowermost position to its fully raised position above the base frame member, during an initial lifting stage the lifting force applied by the associated actuator to the arrangement of link arms and thence to the support frame member acts through a shorter distance from a fulcrum of the arrangement of link arms to the support frame and therefore with a greater moment of force than during a later stage of lifting movement.

9. A bed according to claim 8 wherein the arrangement of link arms includes a primary link arm pivotally movable about one end coupled to the base frame member at the fulcrum, the primary link arm being pivotally mounted at its other movable end to a secondary link arm at a point between the opposite ends of the secondary link arm, one first end of the secondary link arm being pivotally mounted to the support frame member and the other second end of the secondary link arm being coupled to the base frame member by an anchor member extending from an anchor point of the base frame member spaced from the fulcrum with the anchor member allowing some lost motion between the anchor member and the second end of the secondary link arm during the first stage of lifting movement and, upon reaching the limit of the lost motion, the anchor member restrains the second end of the secondary link arm to prevent further movement of that second end away from the anchor point.

10. A bed according to claim 9 wherein the anchor member coupling the second end of the secondary link arm to the base frame member comprises an anchor link providing a pivotal coupling between the second end of the secondary link arm and the anchor link, the pivotal coupling having a pivot pin both pivotally and longitudinally movable within a pivot slot during the first stage of movement of the primary height adjusting mechanism.

11. A bed according to claim 9 wherein, during the first stage of movement of the primary height adjusting mechanism, the secondary link arm extends along and bears against an underside of the support frame member at points along a substantial part of the length of the secondary link arm so as to apply lifting force to the support frame member along a substantial part of the length of the secondary link arm, and whereby after the end of the first stage of lifting movement, the second end of the secondary link arm relatively moves downwardly away from the underside of the support frame member and the lifting force applied by the pivoting and lifting movement of the primary link arm is transmitted to the first end of the secondary link arm to apply lifting force to the support frame member substantially at the point of coupling of the first end of the secondary link arm to the support frame member.

12. A bed according to claim 9 wherein said one or more actuators include a selectively operable drive actuator coupled to a drive crank fixed relative to the primary link arm so as to rotate the primary link arm about its pivotal mounting to the base frame member at the fulcrum.

13. A bed according to claim 12 wherein, when the support frame member is in its lowermost position, the drive actuator and the drive crank to which it is coupled are contained within the base frame member.

14. A bed comprising:

a support member for supporting an individual thereon;

a base member configured to support the support member above a floor surface, the base member comprising a generally rectangular base frame member;

a primary height adjusting mechanism selectively operable to adjust the height of the support member with respect to the base member; and a secondary height adjusting mechanism selectively operable to adjust the height of the base member with respect to the floor surface, the secondary height adjusting mechanism comprising a plurality of legs extendible from an underside of the base frame member, the secondary height adjusting mechanism being operable such that each leg is movable between a retracted position wherein each leg is lifted from the floor surface and an extended position wherein each leg is in contact with the floor surface, wherein when the legs of the secondary height adjusting mechanism are in their extended positions, the base member is supported above the floor surface by the plurality of legs, such that the height of the base member above the floor surface is determined by the lengths of the legs and that height is sufficient to accommodate a base of a patient lifting device, wherein the secondary height adjusting mechanism includes a pair of shafts rotatably mounted to the base frame member at opposing ends thereof, each of the shafts having a plurality of legs mounted thereto, and wherein an actuator device is selectively operable to rotate the shafts to move the legs between their retracted and extended positions.

15. A bed according to claim 14, wherein the actuator device is a linear actuator having a reciprocating drive rod drivingly coupled to a drive crank associated with at least one of the shafts.

16. A bed comprising:

a support member for supporting an individual thereon and having a support frame member;

a base member configured to support the support member above a floor surface and having a base frame member; and a primary height adjusting mechanism providing a connection between the base frame member and the support frame member and being selectively operable to adjust the height of the support member with respect to the base member;

wherein the primary height adjusting mechanism includes an arrangement of a plurality of link arms drivably coupled to one or more actuators operable to selectively raise the support frame member with respect to the base frame member, said arrangement of link arms being configured so that, during raising of the support frame member from its lowermost position to its fully raised position above the base frame member, during an initial lifting stage the lifting force applied by the associated actuator to the arrangement of link arms and thence to the support frame member acts through a shorter distance from a fulcrum of the arrangement of link arms to the support frame and therefore with a greater moment of force than during a later stage of lifting movement.

17. A bed according to claim 16 wherein the arrangement of link arms includes a primary link arm pivotally movable about one end coupled to the base frame member at the fulcrum, the primary link arm being pivotally mounted at its other movable end to a secondary link arm at a point between the opposite ends of the secondary link arm, one first end of the secondary link arm being pivotally mounted to the support frame member and the other second end of the secondary link arm being coupled to the base frame member by an anchor member extending from an anchor point of the base frame member spaced from the fulcrum with the anchor member allowing some lost motion between the anchor member and the second end of the secondary link arm during the first stage of lifting movement and, upon reaching the limit of the lost motion, the anchor member restrains the second end of the secondary link arm to prevent further movement of that second end away from the anchor point.

18. A bed according to claim 17 wherein the anchor member coupling the second end of the secondary link arm to the base frame member comprises an anchor link providing a pivotal coupling between the second end of the secondary link arm and the anchor link, the pivotal coupling having a pivot pin both pivotally and longitudinally movable within a pivot slot during the first stage of movement of the primary height adjusting mechanism.

19. A bed according to claim 17 wherein, during the first stage of movement of the primary height adjusting mechanism, the secondary link arm extends along and bears against an underside of the support frame member at points along a substantial part of the length of the secondary link arm so as to apply lifting force to the support frame member along a substantial part of the length of the secondary link arm, and whereby after the end of the first stage of lifting movement, the second end of the secondary link arm relatively moves downwardly away from the underside of the support frame member and the lifting force applied by the pivoting and lifting movement of the primary link arm is transmitted to the first end of the secondary link arm to apply lifting force to the support frame member substantially at the point of coupling of the first end of the secondary link arm to the support frame member.

20. A bed according to claim 17 wherein said one or more actuators include a selectively operable drive actuator coupled to a drive crank fixed relative to the primary link arm so as to rotate the primary link arm about its pivotal mounting to the base frame member at the fulcrum.

21. A bed according to claim 20 wherein, when the support frame member is in its lowermost position, the drive actuator and the drive crank to which it is coupled are contained within the base frame member.

* * * * *